US007595714B2

(12) United States Patent
Wada

(10) Patent No.: US 7,595,714 B2
(45) Date of Patent: Sep. 29, 2009

(54) IGNITION COIL

(75) Inventor: Junichi Wada, Chita-gun (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 12/216,460

(22) Filed: Jul. 3, 2008

(65) Prior Publication Data

US 2009/0009275 A1 Jan. 8, 2009

(30) Foreign Application Priority Data

Jul. 4, 2007 (JP) ..... 2007-176547
Jun. 9, 2008 (JP) ..... 2008-150465

(51) Int. Cl.
*H01F 27/02* (2006.01)

(52) U.S. Cl. ..... 336/90

(58) Field of Classification Search ..... 336/65, 336/83, 90–96, 206–208; 123/634–635
See application file for complete search history.

(56) References Cited

U.S. PATENT DOCUMENTS

| | | | | |
|---|---|---|---|---|
| 5,335,642 | A * | 8/1994 | Hancock et al. | 123/634 |
| 5,685,065 | A * | 11/1997 | Suzuki et al. | 29/606 |
| 6,294,973 | B1 | 9/2001 | Kimura et al. | |
| 7,212,092 | B2 | 5/2007 | Nuebel et al. | |
| 2005/0237142 | A1* | 10/2005 | Burchett et al. | 336/90 |
| 2007/0181109 | A1 | 8/2007 | Matsui et al. | |
| 2009/0033452 | A1* | 2/2009 | Akimoto | 336/177 |

FOREIGN PATENT DOCUMENTS

| | | |
|---|---|---|
| DE | 29611077 | 12/1997 |
| JP | 6-36950 | 2/1994 |
| JP | 3044716 | 10/1997 |
| JP | 2001-210534 | 8/2001 |
| JP | 2003-37015 | 2/2003 |
| JP | 2005-50892 | 2/2005 |
| JP | 2005-175470 | 6/2005 |
| JP | 2007-66961 | 3/2007 |
| WO | 2007/125009 | 11/2007 |
| WO | 2008/037591 | 4/2008 |

* cited by examiner

*Primary Examiner*—Tuyen Nguyen
(74) *Attorney, Agent, or Firm*—Nixon & Vanderhye, PC

(57) ABSTRACT

An ignition coil includes a primary coil (14), a secondary coil (16) disposed on an outer circumferential side of the primary coil and configured to be boosted by mutual induction with the primary coil, an outer periphery core (18) having an opposing surface (183), which is opposed to an outer peripheral surface (160) of the secondary coil, and an insulating member (20) disposed between the outer peripheral surface and the opposing surface. The secondary coil and the outer periphery core are arranged such that a shortest distance between the outer peripheral surface and an outer edge (183*a*, 183*b*) of the opposing surface is larger than a shortest distance between the outer peripheral surface and the opposing surface.

16 Claims, 12 Drawing Sheets

IGNITION COIL

CROSS REFERENCE TO RELATED APPLICATION

This application is based on and Incorporates herein by reference Japanese Patent Application No. 2007-176547 filed on Jul. 4, 2007, and Japanese Patent Application No. 2008-150465 filed on Jun. 9, 2008.

BACKGROUND OF THE INVENTION

1. Field of the Invention

The present invention relates to an ignition coil which generates a voltage applied to an ignition plug for an internal combustion engine.

2. Description of Related Art

There is conventionally known an ignition coil in which a secondary coil arranged at an outer peripheral side of a primary coil is increased in voltage through mutual induction with the primary coil to generate an applied voltage to an ignition plug. There is proposed an ignition coil as one kind of such an ignition coil in which an outer periphery core is arranged in opposition to an outer peripheral surface of the secondary coil and a plastic member is interposed between the secondary coil and the outer periphery core to realize electrical insulation (for example, JP2005-50892A).

In JP2005-50892A, since outer edges square-built on an inner peripheral surface of the outer periphery core exactly face an outer peripheral surface of the secondary coil, an electrical field generated between the secondary coil and the outer periphery core tends to easily concentrate on the above outer edge. Such local concentration of the electrical field causes a treeing phenomenon in the plastic member between the secondary coil and the outer periphery core to degrade the plastic member. As a result, further degradation of the plastic member produces dielectric breakdown between the outer peripheral surface of the secondary coil and the outer edge on the inner peripheral surface of the outer periphery core. Therefore, a lifetime due to the dielectric breakdown is shortened, raising the problem with durability of the ignition coil.

SUMMARY OF THE INVENTION

The present invention is made in view of the foregoing problem and an object of the present invention is to provide an ignition coil having high durability.

In order to solve the problem, according to an aspect of the present invention, an ignition coil includes a primary coil, a secondary coil, an outer periphery core, and an insulating member. The secondary coil is disposed on an outer circumferential side of the primary coil and is configured to be boosted by mutual induction with the primary coil. The outer periphery core has an opposing surface, which is opposed to an outer peripheral surface of the secondary coil. The insulating member is disposed between the outer peripheral surface and the opposing surface. The secondary coil and the outer periphery core are arranged such that B is larger than A, given that A is a shortest distance between the outer peripheral surface and the opposing surface and B is a shortest distance between the outer peripheral surface and an outer edge of the opposing surface. Here, the outer edge of the opposing surface means all points on the opposing surface of outer periphery core at which its curvature is maximized in macro perspective. Here, "macro perspective" is a counterpart of "micro perspective", and the point at which the curvature is maximized in macro perspective is a point at which a person can visually identify that the curvature is maximized. In consequence, the shortest distance B from the outer edge of the opposing surface of the outer periphery core facing the outer peripheral surface of the secondary coil to the secondary coil is longer than the shortest distance A between the outer peripheral surface and the opposing surface. Therefore, the electrical field is less likely to concentrate on the outer edge of the opposing surface of the outer periphery core. According to this arrangement, since degradation of the insulating member interposed between the outer peripheral surface of the secondary coil and the opposing surface of the outer periphery core due to the local field concentration can be restricted, an effect of avoiding the dielectric breakdown between the secondary coil and the outer periphery core enhances, making it possible to improve durability of the ignition coil.

For example, the secondary coil and the outer periphery core may be arranged so as to satisfy a relation of "$B/A \geqq 1.5$". Therefore, the electrical field concentration on the outer edge of the opposing surface in the outer periphery core is effectively restricted between the secondary coil and the outer periphery core, leading to an enhancement in an avoidance effect of the dielectric breakdown.

In addition, the secondary coil and the outer periphery core may be arranged so as to satisfy a relation of "$B/A \geqq 2.0$". Therefore, the electrical field concentration on the outer edge of the opposing surface in the outer periphery core is more effectively restricted between the secondary coil and the outer periphery core, leading to an enhancement in an avoidance effect of the dielectric breakdown.

For example, the secondary coil is formed in a cylindrical shape having a rectangular cross section, and the outer edge is located away from the opposing surface of the outer periphery core, which is fully opposed to the secondary coil. According to this arrangement, one surface of the secondary coil having a rectangular, cylindrical shape is fully opposed to the opposing surface of the outer periphery core as a flat surface in parallel with the one surface with the shortest distance A therebetween. Further, the one surface is arranged at a distance of the shortest distance B longer than the shortest distance A from the outer edge of the opposing surface away from the fully opposed portion to the one surface. In consequence, the arrangement of preventing the electrical field from concentrating on the outer edge of the opposing surface can be realized by a relatively simple construction which is formed with a combination of the coil in a rectangular shape and the flat surface of the outer periphery core.

The secondary coil may be formed in a cylindrical shape. According to this arrangement, the shortest distance B between the outer edge of the opposing surface of the outer periphery core and the outer peripheral surface of the secondary coil can be made longer relative to the shortest distance A. That is, since the secondary coil is cylindrical, it is possible to satisfy a relation of "$B/A>1$". According to this arrangement, since degradation of the insulating member interposed between the outer peripheral surface of the secondary coil and the opposing surface of the outer periphery core due to the local electrical field concentration can be restricted, an effect of avoiding the dielectric breakdown between the secondary coil and the outer periphery core enhances, thus improving durability of the ignition coil. Even if a cross section of the cylindrical secondary coil is not only a perfect circle but also an ellipse or the like, durability of the ignition coil improves because of the aforementioned reason. When B/A is the same, a length of the opposing surface in its width direction is shorter in a case of using the cylindrical secondary coil as compared to a case of using the secondary coil having the rectangular, cylindrical shape. That is, by using the cylindrical secondary coil, the body size of the ignition coil can be downsized.

The outer periphery core may include a plurality of magnetic plates stacked in a radial direction of the secondary coil, and a magnetic plate of the plurality of magnetic plates may be configured to serve as an entire area of the opposing surface. According to this arrangement, it is possible to form the entire opposing surface of the outer periphery core facing the outer peripheral surface of the secondary coil from one sheet of the magnetic plate. Therefore, concave and convex portions each having a large curvature in micro perspective do not exist on the opposing surface to restrict occurrence of the local electrical field concentration, improving durability of the ignition coil.

The outer periphery core may include a single magnetic plate, which is configured to serve as an entire area of the opposing surface. According to this arrangement, it is possible to form the entire opposing surface of the outer periphery core facing the outer peripheral surface of the secondary coil from one sheet of the magnetic plate. Therefore, concave and convex portions each having a large curvature in micro perspective do not exist on the opposing surface to restrict occurrence of the local electrical field concentration, improving durability of the ignition coil.

For example, the outer periphery core is formed by pressure-molding a magnetic powder. A surface of the outer periphery core formed in such a way does not have concave and convex portions each having a large curvature in micro perspective to include a smooth opposing surface. Therefore, occurrence of the local electrical field concentration on the opposing surface is restricted, thus improving durability of the ignition coil.

The outer edge of the opposing surface of the outer periphery core may be chamfered. Since the local electrical field concentration tends to easily occur at a location having a large curvature, the outer edge on the opposing surface at which the curvature is maximized in macro perspective is chamfered to reduce the curvature. In consequence, occurrence of the local electrical field concentration on the outer edge is restricted, improving durability of the ignition coil.

At least the outer edge of the opposing surface of the outer periphery core may be covered with a stress relaxation member, which is configured to relax a stress generated on an interfacial surface between the outer periphery core and the insulating member. In consequence, at least the stress generated in the boundary face between the outer edge of the opposing surface of the outer periphery core and the insulating member is relaxed by elasticity of the stress relaxation member, thus restricting occurrence of cracks promoting the dielectric breakdown.

For example, the stress relaxation member is a heat shrinkable tube and covers an entire area of the opposing surface of the outer periphery core. According to this arrangement, use of heat shrinkability of the stress relaxation member as the heat shrinkable tube allows the stress relaxation member to be in close contact with the entire surface of the outer periphery core including the outer edge of the opposing surface. Therefore, it is possible to restrict formation of an air layer promoting the dielectric breakdown between the outer periphery core and the stress relaxation member.

For example, a cross-sectional area of the secondary coil in a radial direction thereof on a high-voltage side of the secondary coil in an axial direction thereof is smaller than a cross-sectional area of the secondary coil in a radial direction thereof on a low-voltage side of the secondary coil in an axial direction thereof. According to this arrangement, a distance between the secondary coil and the outer periphery core is made longer in a portion of the secondary coil having a relatively high voltage. As a result, the insulation distance between the secondary coil and the outer periphery core is increased, more effectively restricting the dielectric breakdown.

The outer periphery core may be earthed to the ground. Since a large potential difference is securely produced between the outer periphery core earthed to the ground in this way and the boosted secondary coil, the possibility that the dielectric breakdown due to discharge occurs is high. However, even if the large potential difference is produced between the outer periphery core and the secondary coil, the effect of avoiding the dielectric breakdown due to the local electrical field concentration enhances, making it possible to improve durability of the ignition coil, because the shortest distance B is longer than the shortest distance A.

For example, the ignition coil further includes a central core that is formed by pressure-molding a magnetic powder, and the outer periphery core and the central core constitute a magnetic path. The central core formed by pressing the magnetic powder in this way can reduce manufacturing costs and man-hour as compared to a central core formed by stacking silicon steel plates or the like.

A cross-sectional area of the outer periphery core along a radial direction of the secondary coil may increase in a direction from a high-voltage side toward a low-voltage side of the secondary coil. Since the shortest distance B is longer than the shortest distance A on the high-voltage side of the secondary coil, the local electrical field concentration is restricted to improve durability of the ignition coil.

Therefore, even if the secondary coil on the low-voltage side is arranged so that the shortest distance B is longer than the shortest distance A, this arrangement has little influence on a dielectric breakdown lifetime. In consequence, by reducing the cross section area of the opposing surface on the low-voltage side, it is possible to reduce the volume of the entire outer periphery core, and manufacturing costs of the outer periphery core can be reduced.

BRIEF DESCRIPTION OF THE DRAWINGS

Additional objects and advantages of the present invention will be more readily apparent from the following detailed description of preferred embodiments when taken together with the accompanying drawings. In which.

DETAILED DESCRIPTION OF THE PREFERRED EMBODIMENTS

First Embodiment

Hereinafter, a first embodiment of the present invention will be explained with reference to the drawings.

Figure 1:
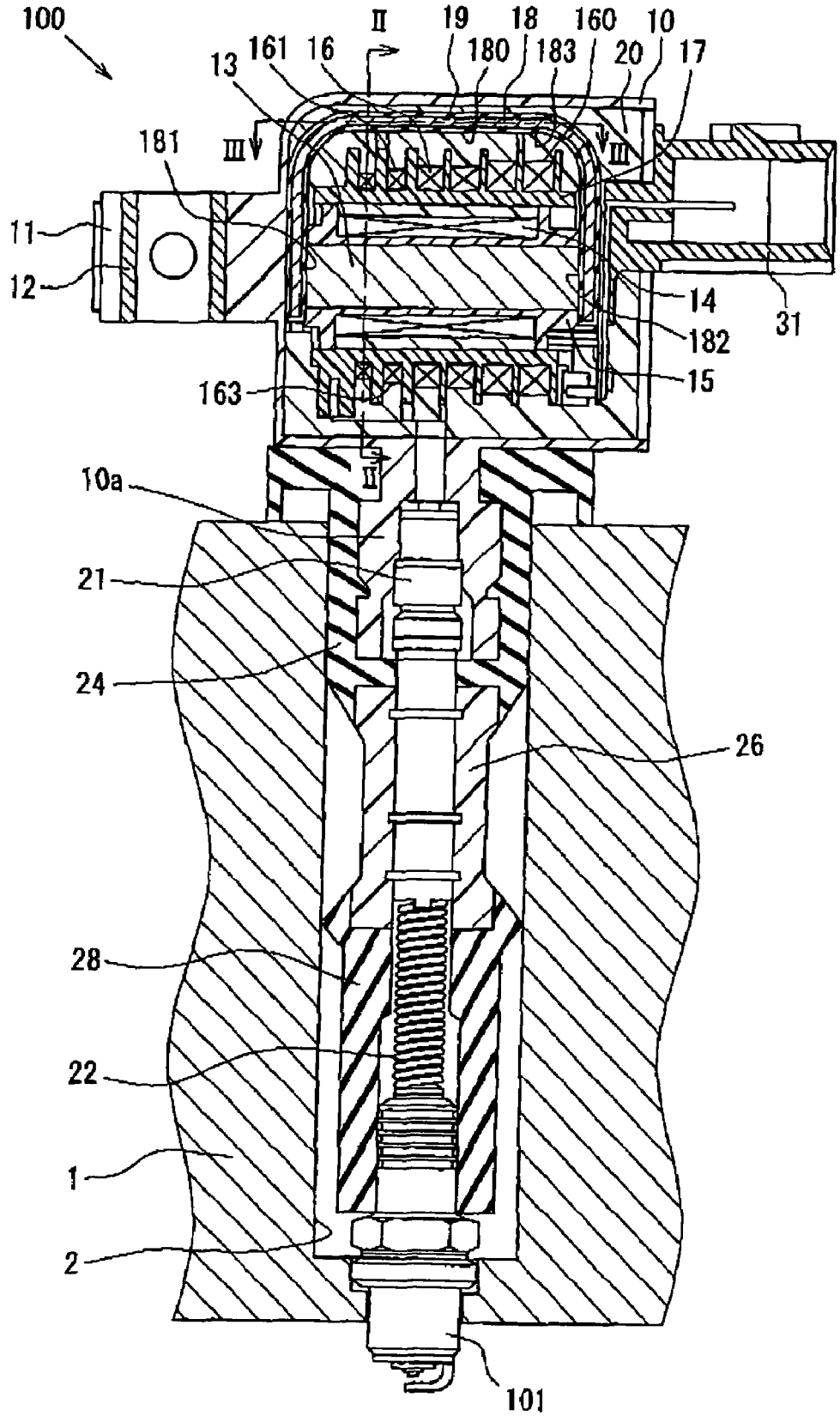
FIG. 1 is a longitudinal sectional view showing an ignition coil according to a first embodiment of the invention.
Figure 2:
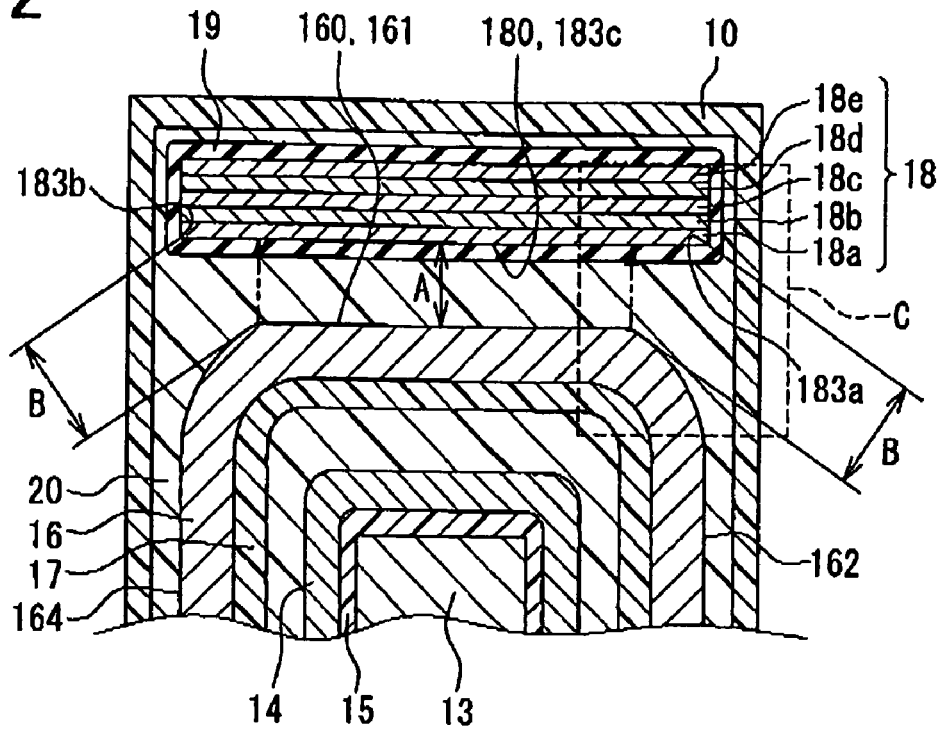
FIG. 2 is a cross-sectional view taken along line II-II in FIG. 1.
Figure 3:
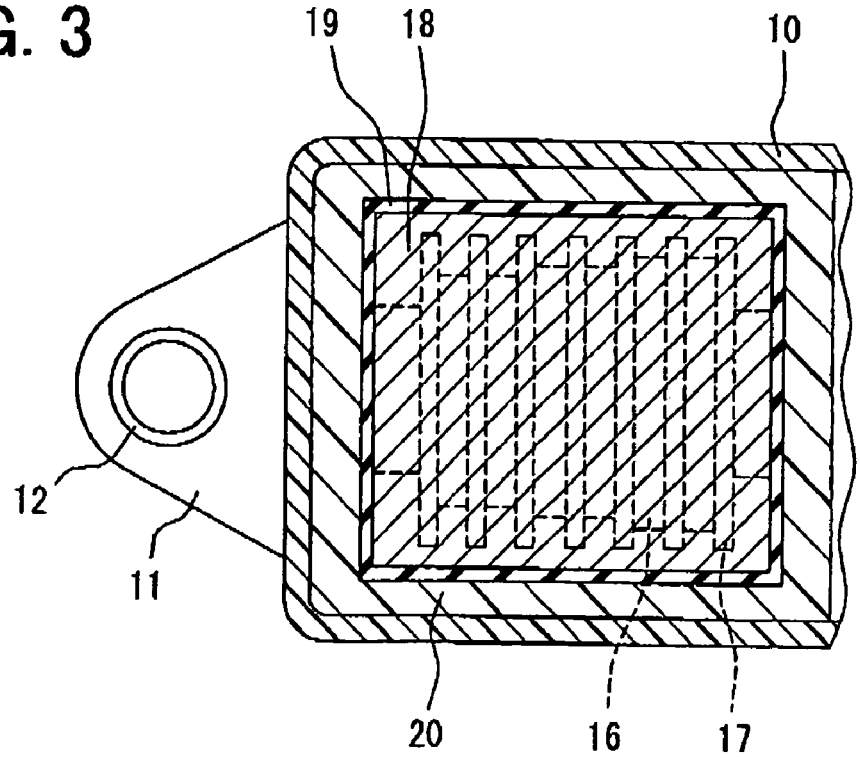
FIG. 3 is a cross-sectional view taken along line III-III in FIG. 1.

As shown in FIGS. 1 to 3, a housing 10 is made of a plastic material and formed in a rectangular, boxy shape with a bottom surface larger than a transverse cross section area of a plug hole 2 in an engine head 1. The housing 10 is arranged outside of the plug hole 2. A fixed portion 11 is formed integrally with the housing 10 at an outside thereof. A tubular metal bush 12 is fitted into the fixed portion 11, which is fixed to the engine head 1 by a bolt (not shown) screwed with the metal bush 12.

It should be noted that the housing 10 and the fixed portion 11 in the present embodiment are made of PBT as a hard resin, but may be made of a thermoplastic resin obtained from condensation polymerization of DMT (dimethyl terephthalate) such as PET and PCT, and 1.4BT (1-4 butanediol) or of a heat-hardening resin such as unsaturated polyester.

As shown in FIG. 2, a central core 13, a primary coil 14, a primary spool 15, a secondary coil 16, a secondary spool 17 and an outer periphery core 18 are accommodated inside of the housing 10.

The central core 13 is made of a magnetic material (not shown) and formed in a rectangular, columnar shape. The central core 13 is arranged so that the axial direction thereof is substantially perpendicular to an axial direction of the plug hole 2. The primary spool 15 is made of a plastic material and formed in a rectangular, tubular shape. The central core 13 of the present embodiment is formed by stacking magnetic plates such as silicon steel plates, but if the magnetic field capable of generating a desired high voltage in the secondary coil 16 can be formed, there is particularly no limitation to the plate width and the stacked sheet numbers of the magnetic plate.

The primary spool 15 is arranged coaxially with the central core 13 at an outer periphery side thereof. The primary coil 14 is configured by winding, for example, an enamel wire around the primary spool 15 and is formed in a rectangular shape as a whole. It should be noted that the primary coil 14 is preferably configured by winding an enamel wire having, for example, a diameter of 0.3 to 0.8 mm around the primary spool 15 by 100 to 230 turn times of wire.

The secondary spool 17 is made of a plastic material and is formed in a rectangular, tubular shape larger than the primary spool 15. The secondary spool 17 is fitted to the outer periphery side of the primary spool 15, thereby being arranged coaxially with the primary spool 15 at the outer periphery side of the primary coil 14 to be spaced from the primary coil 14. The secondary spool 17 is provided with disc-shaped collars projecting in a radially outward direction at predetermined intervals. The secondary coil 16 is formed by slot-winding, for example, an enamel wire around the secondary spool 17 and is formed in a rectangular, tubular shape as a whole. The secondary coil 16 is preferably configured by winding an enamel wire having, for example, a diameter of 40 to 50 μm by 10000 to 20000 turn times of wire.

The outer periphery core 18 is made of a magnetic material, formed in a U-letter shape and is arranged on the outer periphery side of the secondary coil 16 to be spaced from the secondary coil 16. The outer periphery core 18 is earthed to the ground through an earth bar (not shown).

Among three flat surfaces 181 to 183 constituting an inner peripheral surface 180 of the outer periphery core 18, the two flat surfaces 181 and 182 opposed to each other cover both end surfaces of the central cores 13 in an axial direction thereof. Thereby, a closed magnetic path is formed from the outer periphery core 18 and the central core 13. On the other hand, the flat surface 183 substantially perpendicular to the two flat surfaces 181 and 182 on the inner peripheral surface 180 of the outer periphery core 18 faces one surface 161 among four flat surfaces 161 to 164 constituting an outer peripheral surface 160 of the secondary coil 16 substantially in parallel with the flat surface 161. The flat surface 183 in the present embodiment corresponds to "opposing surface", and hereinafter, the flat surface 183 is called the opposing surface 183.

The outer periphery core 18 in the present embodiment is formed by stacking five sheets of magnetic plates 18*a* to 18*e* (refer to FIG. 2) having silicon steel plates, but if magnetic plates to be used can form the magnetic field enough for generating a desired high voltage in the secondary coil 16, there is particularly no limitation to the plate width and the stacked sheet numbers of the magnetic plate. In the present embodiment, the closed magnetic path is formed by the outer periphery core 18 and the central core 13, but if a desired high voltage can be generated in the secondary coil 16 by mutual induction (to be described later), an open magnetic path may be formed by the outer periphery core 18 and the central core 13.

A plastic member 20 fills the inside of the housing 10 accommodating such an outer periphery core 18 or the like. The plastic member 20 is interposed between the outer peripheral surface 160 of the secondary coil 16 and the inner peripheral surface 180 of the outer periphery core 18 to electrically insulate the secondary coil 16 from the outer periphery core 18. The plastic member 20 is also interposed between the primary coil 14 and the secondary spool 17, which are electrically insulated from each other by the plastic member 20. The plastic member 20 in the present embodiment is a heat-hardening resin such as an epoxy resin, but another plastic member for performing an electrically insulating function may be used. Further, for improving an electrically insulating characteristic of the plastic member 20, particles having the insulating characteristic such as silica may be added to the plastic member 20. The plastic member 20 in the present embodiment corresponds to "insulating member".

As shown in FIG. 1, a seal member 24 is made of a rubber material and formed in a cylindrical shape. The seal member 24 is inserted coaxially into the plug hole 2 except for one end of the seal member 24 supporting the housing 10. A high-voltage tower portion 10*a* formed integrally with the housing 10 is accommodated inside the seal member 24, and a high-voltage terminal 21 connected electrically to a high-voltage side (wire winding end) of the secondary core 16 is accommodated inside the high-voltage tower portion 10*a*. The seal member 24 performs sealing between a pole 26 and the plug hole 2.

The pole 26 is made of a plastic material such as PBT, PPS and unsaturated polyester and is formed in a cylindrical shape. The pole 26 is inserted coaxially into the plug hole 2 and is connected to an end of the seal member 24 on the opposite side of the housing 10.

A plug cap 28 is made of a rubber material and is formed in a cylindrical shape. The plug cap 28 is inserted coaxially into the plug hole 2 and is connected to an end of the pole 26 on the opposite side of the seal member 24. A conductive spring 22 for electrically connecting the high-voltage terminal 21 to a spark plug 101 fixed to an engine head 1 is accommodated inside the plug cap 28. The plug cap 28 performs electrical insulation between the conductive spring 22 and the plug hole 2.

In the above arrangement, signals from an engine control unit (not shown) and a power source are supplied through a connector 31. When electric current flowing in the primary coil 14 is blocked by an igniter (not shown), a high voltage of, for example, 30 to 40 kV is generated in the secondary coil 16 by mutual induction function between the primary and secondary coils 14 and 16. The high voltage generated in the secondary coil 16 in this way is led to the ignition plug 101 through the high-voltage terminal 21 and the conductive spring 22, resulting in generating spark discharge at a tip of the ignition plug 101.

Hereinafter, a featuring arrangement of the present embodiment will be in detail explained.

As shown in FIG. 2, on an opposing surface 183 of the outer periphery core 18, outer edges 183*a* and 183*b* at both ends of the opposing surface 183 in the width direction (right-left direction in FIG. 2) are formed at positions away from an exact opposed portion 183*c* exactly facing a flat surface 161 of the secondary coil 16. In this arrangement, the outer edges 183*a* and 183*b* mean all points at which the curvature of the opposing surface 183 is maximized in macro perspective at its sides constituting both ends of the opposing surface 183 in its width direction, or in the vicinity of the above sides of the opposing surface 183. That is, in the present embodiment, the outer edges 183*a* and 183*b* exist linearly along an axial direction of the secondary coil 16 on the opposing surface 183. A distance from the outer edge 183*a* to an axis center of the secondary core 16 is the same as that from the outer edge 183*b* to the axis center of the secondary core 16, Arrows shown in chain double-dashed lines in FIG. 2 indicate both ends of the flat surface 161 in its width direction, on the opposing surface 183, and the outer edges 183*a* and 183*b* are positioned away from the exact opposed portion 183*c*.

Figure 4:
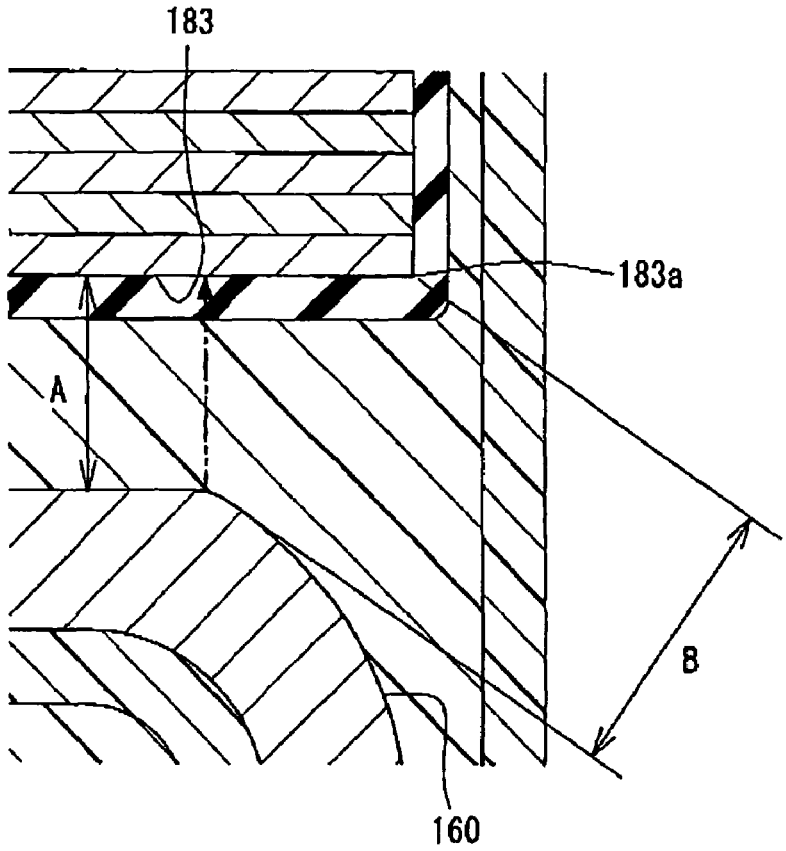
FIG. 4 is an enlarged diagram showing a main section C in FIG. 2.

According to this arrangement, a parallel clearance A between the exact opposed portion 183*c* and the flat surface 161 is equal to the shortest distance A between the opposing surface 183 of the outer periphery core 18 and the outer peripheral surface 160 of the secondary coil 16. In addition, as shown in FIG. 4 which is an enlarged diagram of a part C in FIG. 2, the shortest distance B from the outer edge 183*a* of the opposing surface 183 to the outer peripheral surface 160 of the secondary coil 16 is longer than the shortest distance A. In the present embodiment, the shortest distance B from the outer edge 183*a* of the opposing surface 183 to the outer peripheral surface 160 of the secondary coil 16 is equal to the shortest distance B from the outer edge 183*b* to the outer peripheral surface 160. Such a relation between the shortest distance A and the shortest distance B is established at an entire region in the axial direction.

Figure 5:
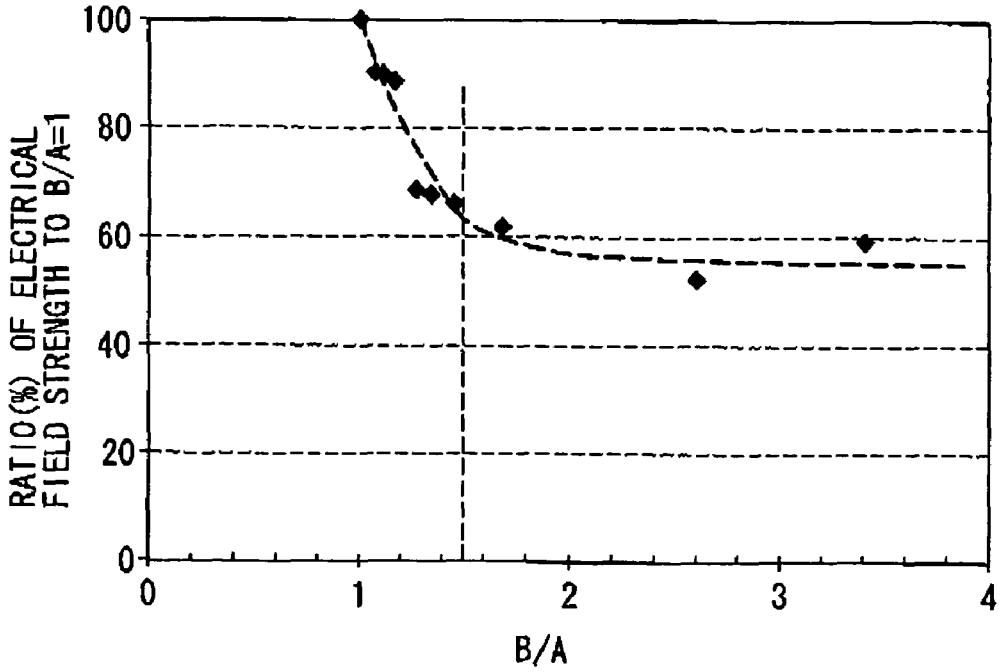
FIG. 5 is a graph showing a relationship between B/A and a ratio of electrical field strength to B/A=1 according to the first embodiment.

Here, FIG. 5 shows a relation of an electrical field strength between the secondary coil 16 and the outer periphery core 18 to a ratio B/A of the shortest distance B to the shortest distance A. An electrical field strength means a strength (stress) of an electrical field generated between the secondary coil 16 and the outer periphery core 18 spaced by the plastic member 20 from each other and does not mean a strength (proof strength) of the plastic member 20 against the electrical filed.

Here, FIG. 5 shows a relation between B/A and a ratio of the electrical field strength to "B/A=1" with the shortest distance B varied using different outer periphery cores 18 which have different lengths in their width direction (right-left direction in FIG. 2). FIG. 5 is a graph calculated by a 2D electrostatic field analysis method using electrical field strength calculation software (ANSYS 10.0 produced by ANSYS CO.). ANSYS 10.0 is one unit including a preprocessor, a solver and a postprocessor.

It is found out from the relation in FIG. 5 that when the shortest distance B is longer than the shortest distance A, that is, when a relation of "B/A>1" is satisfied, the electrical field strength between the secondary coil 16 and the outer periphery core 18 is reduced. Particularly, when a relation of "B/A≧1.5" is satisfied, the electrical field strength is reduced to, for example, about 60% as compared to an arrangement of B/A=1 (for example, conventional art). The reason for this is as follows. When a relation of "B/A=1" is satisfied, the electrical field concentrates on the outer edges 183*a* and 183*b* of the opposing surface 183 in which the curvature of the opposing surface 183 in the outer periphery core 18 is maximized in macro perspective. On the other hand, when the shortest distance B is longer than shortest distance A, particularly, when a value of B/A is larger than 1.5, the local electrical field concentration on the outer edges 183*a* and 183*b* is limited.

In this way, when the electrical field strength is reduced and the local electrical field concentration is limited, a treeing phenomenon as an electrical insulation degradation phenomenon in the plastic member 20 is restricted. That is, the insulation degradation of the plastic member 20 between the secondary coil 16 and the outer periphery core 18 is alleviated. The treeing phenomenon means a phenomenon in which a high electrical field portion caused by the electrical field concentration exceeds a specific breakdown limit of the plastic member 20 to generate local dielectric breakdown, an arborescent discharge path (tree) is gradually developed, and finally the tree breaks down all paths between the secondary coil 16 and the outer periphery core 18.

In consequence, according to the present embodiment, even if the ignition coil 100 has the same size as the body size in the conventional one, a lifetime (dielectric breakdown lifetime) of the plastic member 20 against the dielectric breakdown of the plastic member 20 between the secondary coil 16 and the outer periphery core 18 can be improved to increase durability of the ignition coil 100. Particularly, when a relation of "B/A≧1.5" is satisfied, since an extension effect on the dielectric breakdown lifetime increases, the ignition coil 100 extremely excellent in durability can be obtained.

Conversely, for satisfying a need for downsizing the ignition coil 100, a value of the shortest distance A is made small, and also the secondary coil 16 and the outer periphery core 18 are arranged so that the shortest distance B is longer than the shortest distance A. Thereby, the downsizing of the ignition coil 100 can be realized, and also durability of the ignition coil 100 similar to that of the conventional one can be secured.

According to FIG. 5, when a relation of "B/A≧2.0" is satisfied, the electrical field concentration on the outer edges 183*a* and 183*b* is reduced to about 55% as compared to an arrangement of "B/A=1" and saturated. Therefore, it is preferable to arrange the secondary coil 16 and the outer periphery core 18 so that a relation of "B/A≧2.0" is satisfied, particularly, a relation of "B/A=2.0" is satisfied.

From the above-mentioned, it should be understood that the electrical field strength is in proportion to a generation voltage of the secondary coil 16 and is in inverse proportion to B/A. Particularly for restricting the local electrical field concentration, it is preferable that the shortest distance B is longer than the shortest distance A and a relation of "B/A≧1.5" is satisfied. More preferably, as described above, a relation of "B/A≧2.0" is satisfied.

Here, the secondary coil 16 of the present embodiment is, as shown in FIGS. 2 and 3, configured so that the winding number of the coil 16 at the high-voltage side generating a relatively high voltage at the side of the fixed portion 11 (left side in FIG. 3) is smaller than at the low-voltage side in the right side in FIG. 3. In consequence, the insulation distance between the secondary coil 16 and the outer periphery core 18 at the high-voltage side exerting a significant influence on the dielectric breakdown lifetime of the ignition coil 100 is longer than at the low-voltage side. Therefore, the dielectric breakdown lifetime of the ignition coil 100 is lengthened.

Next, as shown in FIG. 2, magnetic plates 18*a* to 18*e* constituting the outer periphery core 18 are stacked in the radial direction of the secondary coil 16. Therefore, the entire opposing surface 183 of the outer periphery core 18 is formed from one sheet of the magnetic plate 18*a* in the innermost periphery of the outer periphery core 18, and the opposing surface 183 is a smooth flat surface without concave and convex portions in which the curvature is large in micro perspective. Therefore, generation of the local electrical field concentration is restricted between the secondary coil 16 and the outer periphery core 18.

Figure 24:
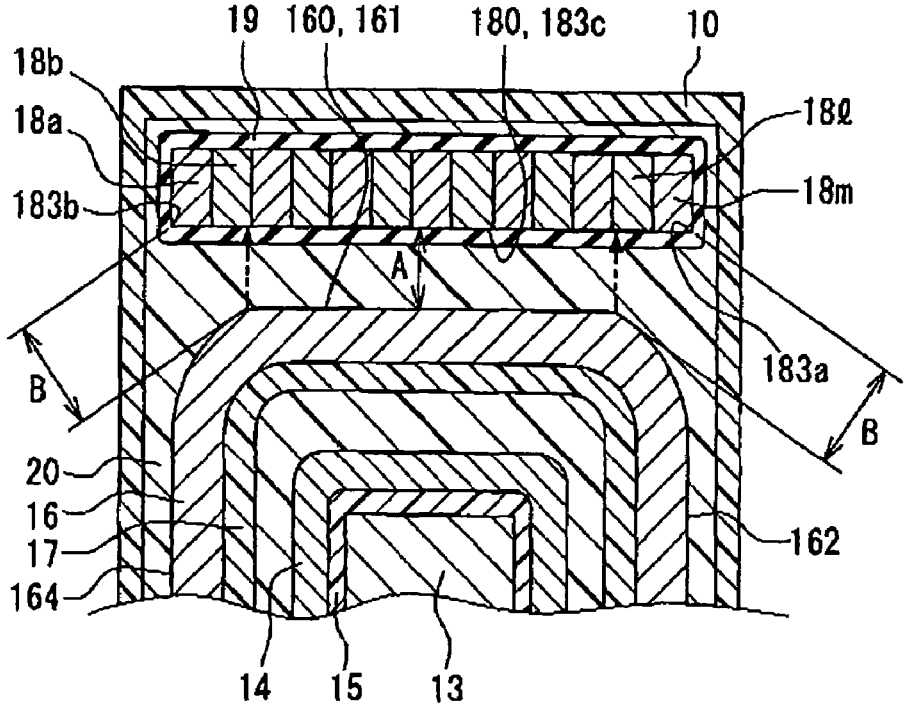
FIG. 24 RELATED ART
FIG. 24 is a diagram illustrating an example in comparison with FIG. 2.

On the other hand, FIG. 24 shows a comparative example in which the outer periphery core 18 is formed by stacking the magnetic plates 18*a* to 18*m* in a direction substantially perpendicular to the radial direction of the secondary coil 16. In this arrangement, concave and convex portions each having a large curvature in macro perspective or in micro perspective tend to be generated on the opposing surface 183 as a result of a variation in size of each of the stacked magnetic plates 18*a* to 18*m*, and a variation in joint strength between the magnetic plates 18*a* and 18*m*. Therefore, in the arrangement shown in FIG. 24, the concave and convex portions on the opposing surface 183 become sites for generating the local electrical field concentration, possibly leading to deterioration in durability of the ignition coil 100.

Figure 6:
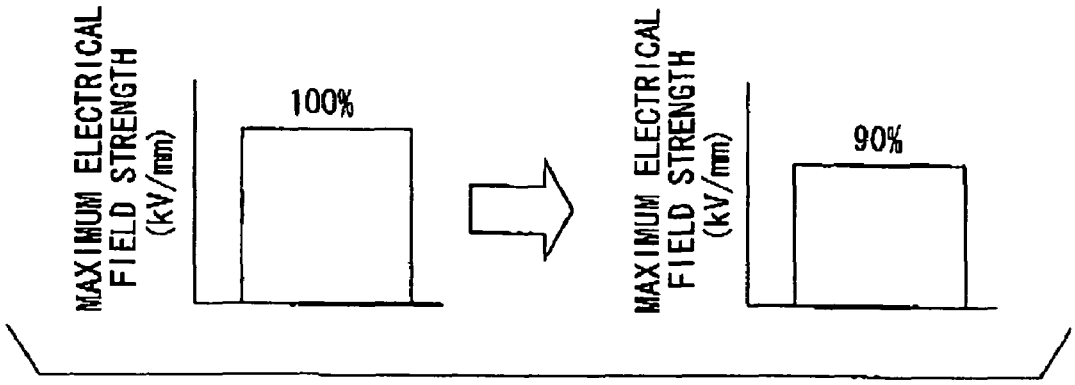
FIG. 6 is a comparison diagram of generated maximum electrical field strength between FIG. 2 and FIG. 24.

FIG. 6 is a diagram showing the maximum electrical field strength in the arrangement shown in FIG. 2 when the maximum electrical field strength generated between the secondary coil 16 and the outer periphery core 18 is assumed to be 100% in the arrangement shown in FIG. 24 (left side in FIG. 6 corresponds to FIG. 24, and right side in FIG. 6 corresponds to FIG. 2).

According to FIG. 6, in the present embodiment, as compared to the arrangement shown in FIG. 24, the maximum electrical field strength generated between the secondary coil 16 and the outer periphery core 18 is reduced to the order close to 90%, making it possible to further increase an effect of avoiding the dielectric breakdown between the elements 16 and 18. Further, the present embodiment can alleviate losses of magnetic energy attributable to generation of vortex current in the outer periphery core 18, due to a stacked shape of the magnetic plates 18*a* to 18*e*.

The outer periphery core 18 in a U-letter shape formed by stacking the magnetic plates 18*a* to 18*e* in the radial direction of the secondary coil 16 can be formed in such a manner that, for example, the magnetic plates 18*a* to 18*e* having thickness of about 0.2 to 1.0 mm and having different lengths are fixed to each other by an adhesive and at the same time, stacked substantially stepwise, and thereafter, their central portions are held while loads are applied on the magnetic plates 18*a* and 18*e* in their thickness direction to bend them in a U-letter shape.

Figure 7:
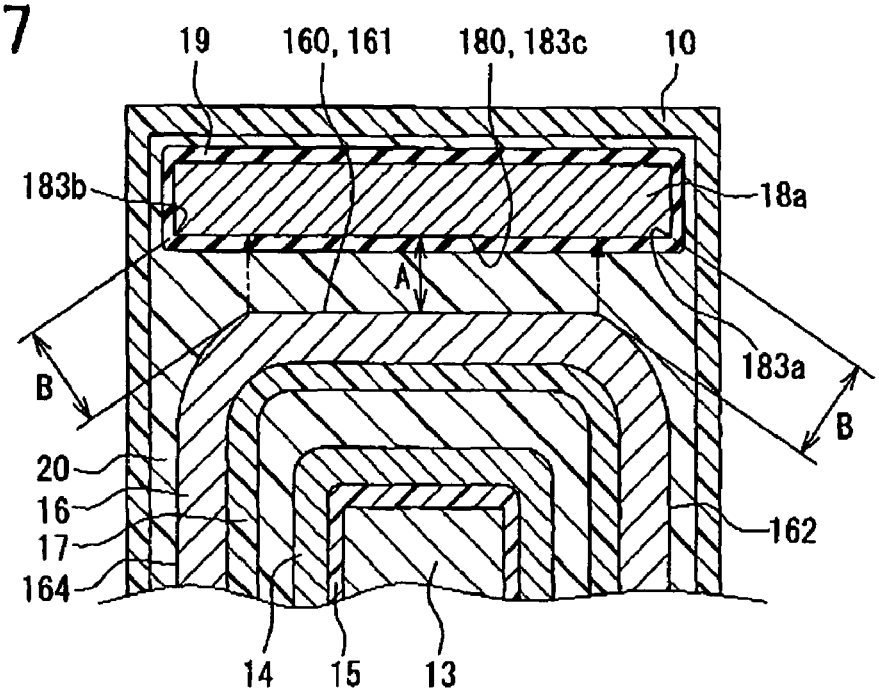
FIG. 7 is a diagram showing a modification of the first embodiment.

For cutting down on costs as much as possible, as shown in FIG. 7, the outer periphery core 18 is configured by one sheet of the magnetic plate 18*a*, and the entire opposing surface 183 is formed by the magnetic plate 18*a*. According to this arrangement also, in the same way as the above embodiment, occurrence of the local electrical field concentration can be restricted to enhance an effect of avoiding the dielectric breakdown.

Further, since a difference in linear thermal expansion coefficient between the plastic member 20 and the outer periphery core 18 as shown in FIG. 2 exists, stress tends to be easily generated in the boundary face between the plastic member 20 and the outer periphery core 18. When this stress causes a crack in the boundary face between the plastic member 20 and the outer periphery core 18, an air layer through which electricity easily passes is formed in the boundary face. Therefore, the dielectric breakdown may be promoted by a treeing phenomenon.

Figure 8:
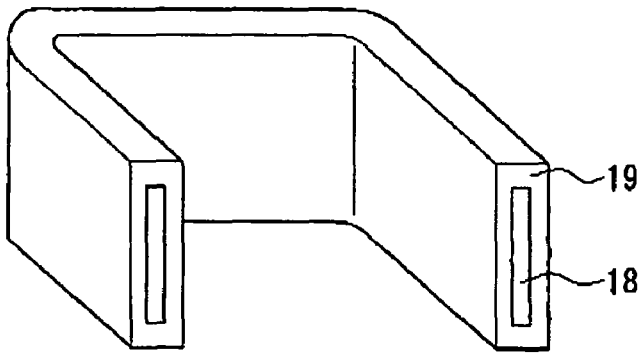
FIG. 8 is an external view showing an outer periphery core and a stress relaxation member according to the first embodiment.

Therefore, in the present embodiment as shown in FIG. 8, the surface of the outer periphery core 18 is covered with a stress relaxation portion 19. Here, the stress relaxation member 19 of the present embodiment is a heat shrinkable tube formed from a polyethylene resin having resilience and is in close contact with an entire surface of the core 18 to accommodate the outer periphery core 18 therein.

According to this stress relaxation member 19, the stress generated in the boundary face between the plastic member 20 and the outer periphery core 18 can be relaxed by a resilient function of the stress relaxation member 19 itself to restrict formation of the air layer due to generation of the crack. Further, the resilient function prevents the air layer from being generated between the stress relaxation member 19 itself and the outer periphery core 18. In consequence, use of the stress relaxation member 19 causes an effect of avoiding the dielectric breakdown to be further improved.

By using the stress relaxation member 19 accommodating therein the outer periphery core 18 configured by stacking the magnetic plates 18*a* to 18*e*, the magnetic plates 18*a* to 18*e* jointed by an adhesive or the like can be more securely united. Therefore, it is possible to form a stable magnetic path.

Further, a method of molding the stress relaxation member 19 by pouring an elastomer around the outer periphery of a core is developed as a manufacturing method of the stress relaxation member 19. However, since liquidity of the elastomer is poor, the stress relaxation member 19 needs a thickness of about 1.0 mm, for example, and therefore, the manufacturing cost has been high. In contrast, since the heat shrinkable tube as the stress relaxation member 19 can reduce its thickness to, for example, the order of 0.35 mm, the stress relaxation member 19 not only contributes to the downsizing of the ignition coil 100, but also can be inexpensively manufactured by covering the outer periphery core 18 with the heat shrinkable tube and then thermally contracting the heat shrinkable tube without use of a molding die.

It should be noted that in the present embodiment, the central core 13 may be also covered with the stress relaxation member 19 in the same way as the outer periphery core 18.

As shown in FIG. 3, an outer diameter or a radial-direction cross section area of the secondary coil 16 is made smaller at the high-voltage side (left side in FIG. 3) than at the low-voltage side (right side in FIG. 3) in an axial direction of the secondary coil 16. Thereby, a distance between the outer peripheral surface 160 of the secondary coil 16 and the opposing surface 183 of the outer periphery core 18 at the high-voltage side is relatively long. In consequence, the shortest distances A and B both at the high-voltage side of the secondary coil 16 increase to increase the insulation distance, thus lengthening the dielectric breakdown lifetime of the ignition coil 100.

Second Embodiment

Hereinafter, the second embodiment will be described, but since the fundamental arrangement thereof is the same as in the first embodiment, different points from the first embodiment only will be explained below.

Figure 9:
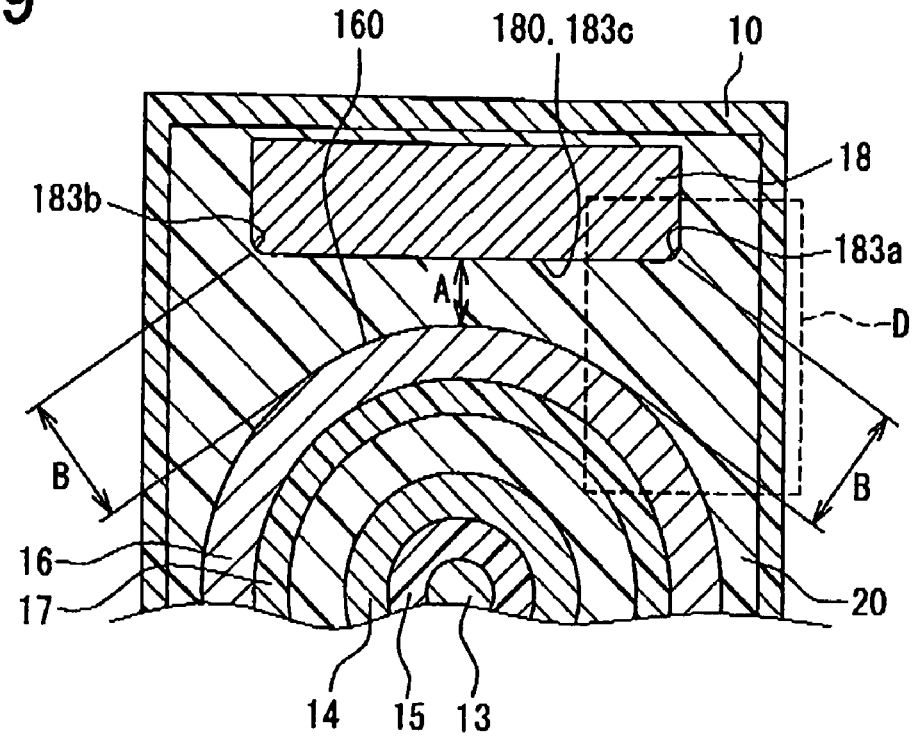
FIG. 9 is a diagram showing a second embodiment of the invention.

FIG. 9 shows a cross section of the ignition coil 100 in its axial direction in the second embodiment. Components corresponding to those in FIG. 2 are referred to as the same numerals. As shown in FIG. 9, a columnar central core 13, a cylindrical secondary coil 16, a cylindrical primary spool 15, a cylindrical primary coil 14 and a cylindrical secondary spool 17 are used. An outer periphery core 18 is formed by pressing magnetic powder, for example, powder of a magnetic metal unit such as iron, cobalt and nickel or an alloy including mainly the metal unit. In consequence, the outer periphery core 18 can be produced less expensively than the one formed by stacking silicon steel plates or the like. By using the cylindrical secondary coil 16, the shortest distance B between each of outer edges 183*a* and 183*b* of the outer periphery core 18 having a rectangular cross section and an outer peripheral surface 160 of the secondary coil 16 is relatively longer than the shortest distance A between an exact opposed portion 183*c* and the outer peripheral surface 160. Accordingly, as compared to a case where the outer periphery core 18 having the rectangular cross section and the secondary coil 16 having the rectangular cross section are used to form the outer edges 183*a* and 183*b* at locations away from the exact opposed portion 183*c* exactly facing a flat surface 161 of the secondary coil 16 as in the case of the first embodiment, it is easier to establish a relation of "B/A≧1.5". Therefore, a relation of "B/A≧1.5" can be realized without increasing the body size of the ignition coil 100, improving durability of the ignition coil 100.

Figure 10:
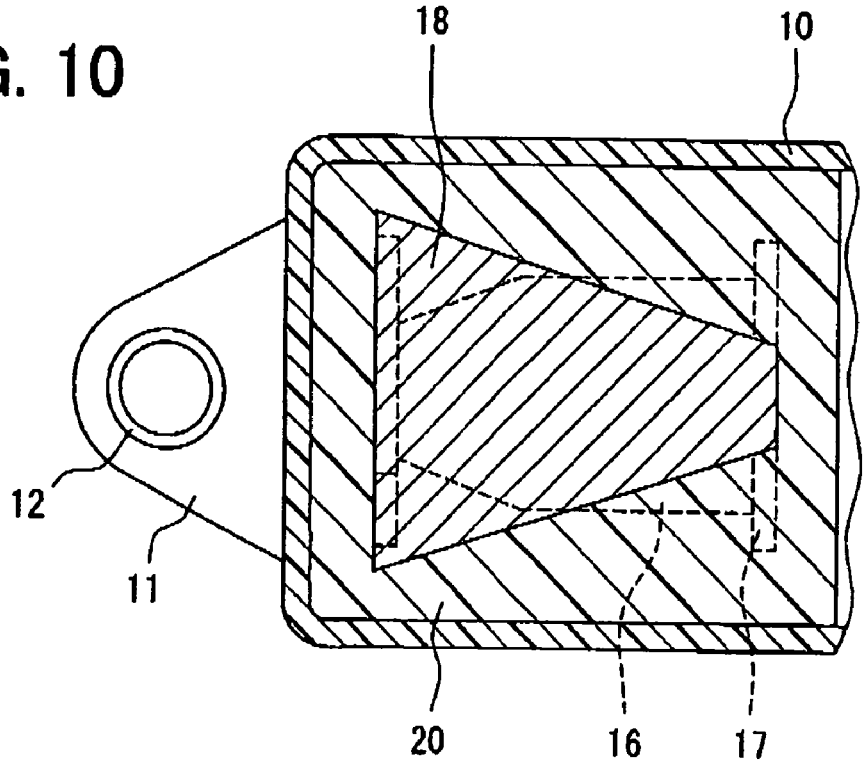
FIG. 10 is a diagram showing a modification of FIG. 3 according to the second embodiment.

Here, in a case where the shortest distance A is substantially constant over an entire region of the secondary coil 16 in its axial direction in the ignition coil 100, it is not required to realize a relation of "B/A≧1.5" over the above entire region in the axial direction. In this case, it may be possible to adopt an arrangement of realizing a relation of "B/A≧1.5" in at least a portion where the electrical field strength is relatively large, that is, only at the high-voltage side (left side) of the secondary coil 16 as shown in FIG. 10. The electrical field strength is substantially in proportion to a voltage generated in the secondary coil 16. The voltage generated in the secondary coil 16 is in proportion to the winding number of an enamel wire wound around the secondary coil 16. Therefore, in a case of performing slot winding or slant-direction winding on the secondary coil 16, the electrical field strength increases from the low-voltage side (right side in FIG. 10) toward the high-voltage side (left side in FIG. 10) in the axial direction of the secondary coil 16 and reaches the maximum electrical field strength at a point of the secondary coil 16 where the maximum high voltage is generated. That is, the maximum electrical field strength dominates the dielectric breakdown lifetime of the plastic member 20.

In the present embodiment, when the electrical field strength of the secondary coil 16 at the high-voltage side satisfies a relation of "B/A≧1.5", the maximum electrical field strength with its value reduced to about 60% has a direct impact on durability of the ignition coil 100. Therefore, a relation of "B/A≧1.5" may not be required in regard to the outer peripheral surface 160 of the secondary coil 16 having the electrical field strength smaller than the maximum electrical field strength value reduced to about 60%. More specially, as shown in FIG. 10, by using the outer periphery core 18 such that the cross section area of the secondary coil 16 in its radial direction increases relatively toward the low-voltage side of the secondary coil 16, an arrangement of the ignition coil 100 in which the shortest distance B is longer than the shortest distance A only at the high-voltage side may be adopted. For example, the above outer periphery core 16 may have a cross section parallel with an axial direction of the secondary coil 16, which is formed substantially in a trapezoidal shape. Thereby, the volume of the outer periphery core 18 is reduced, reducing manufacturing costs of the ignition coil 100.

Here, "slant-direction winding" means a method of forming the secondary coil 16. That is, first at the high-voltage side of the secondary coil 16, an enamel wire is wound so that an outer diameter of the secondary coil 16 is reduced toward the high-voltage side of the secondary coil 16 to form a slant surface in a part of the secondary coil 16. Thereafter, the enamel wire is wound in the axial direction to be in parallel to the slant surface and for the outer diameter of the secondary coil 16 to be substantially equal to the maximum value of the outer diameter of the slant surface, thus forming the secondary coil 16. In the present embodiment, because of the slant-direction winding, as shown in FIG. 10, an outer diameter or a cross section area of the secondary coil 16 in its radial direction at the high-voltage side is smaller than at the low-voltage side.

From the above-mentioned, for improving durability of the ignition coil 100, in the secondary coil 16, it is required to satisfy a relation of "B/A≧1.5" at least at the high-voltage side of the outer peripheral surface 160 in the secondary coil 16, more specially at a point generating a voltage higher than that at the point where the winding number of the secondary coil 16 is about 60%.

Figure 11:
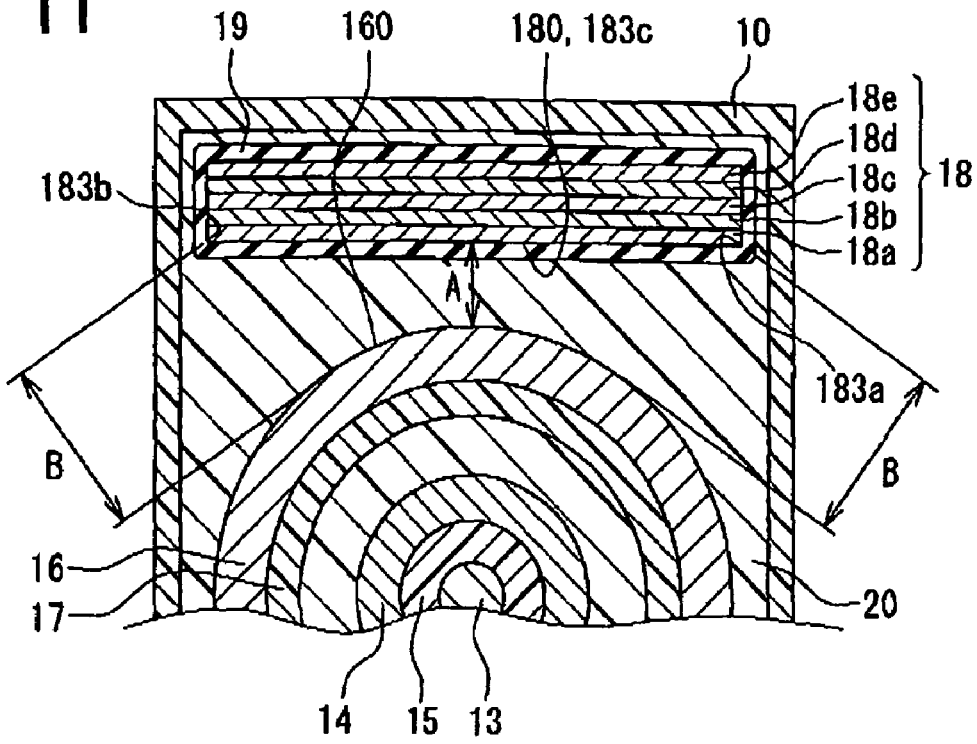
FIG. 11 is a diagram showing a modification of the second embodiment.

The entire outer peripheral surface of the outer periphery core 18 molded by pressing including the opposing surface 183 has a smooth flat surface having a few concave and convex portions whose curvature is large in macro perspective and in micro perspective. Therefore, as compared to a comparative example in FIG. 24, the local electrical field concentration is less likely to be generated, thus improving durability of the ignition coil 100. As shown in FIG. 11, the ignition coil 100 may be configured by using the outer periphery core 18 formed by stacking silicon steel plates or the like and the cylindrical secondary coil 16 as in the case of the first embodiment.

Figure 12:
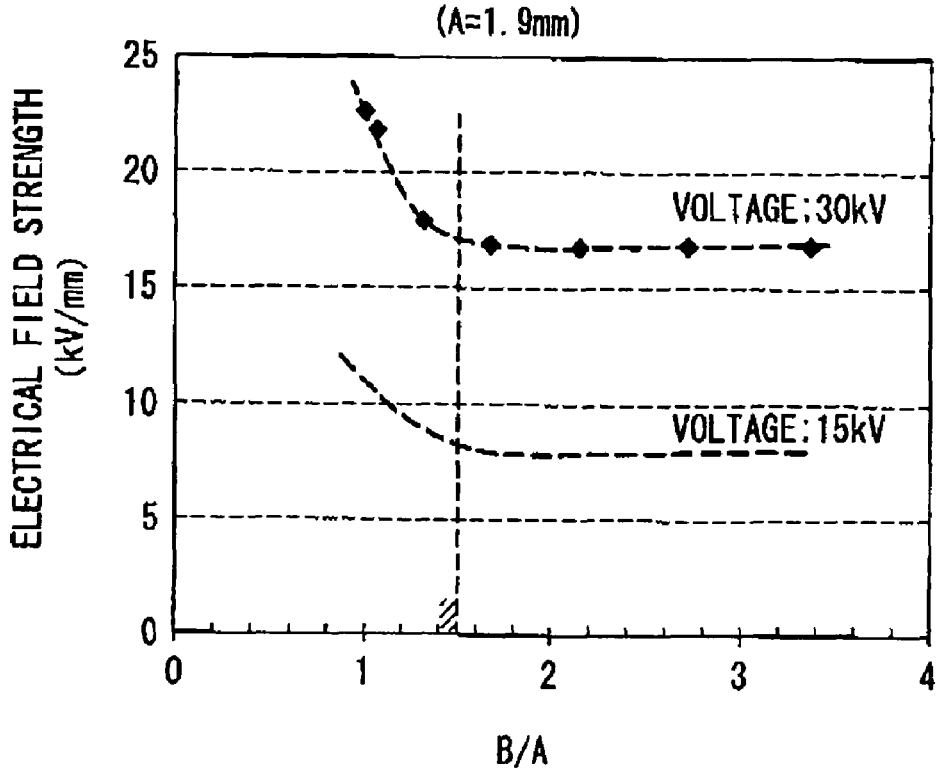
FIG. 12 is a graph showing a relationship between B/A and electrical field strength according to the second embodiment.

Here, FIG. 12 shows a relation of B/A and electrical field strength (kV/mm) with the shortest distance B varied by using outer periphery cores 18 having different lengths in the width direction (right-left direction in FIG. 9) in a state where A=1.9 mm, a voltage generated in the secondary coil 16 is 30 kV and the outer periphery core 18 is earthed to the ground. FIG. 12 is, in the same way as the first embodiment in FIG. 5, a graph calculated by a 2D electrostatic field analysis method using electrical field strength calculation software (ANSYS 10.0 produced by ANSYS CO.). ANSYS 10.0 is one unit including a preprocessor, a solver and a postprocessor.

It should be understood that FIG. 12 in which a vertical axis shows electrical field strength (kV/mm) and a lateral axis shows B/A shows a tendency similar to FIG. 5 in which a vertical axis shows electrical field strength ratio (%) to "B/A=1" and a lateral axis shows B/A. That is, in the ignition coil 100 using the outer periphery core 18 having a rectangular cross section, when the generation voltage of the secondary coil 16 is constant, the electrical field strength generated in the ignition coil 100 is determined by B/A whether the configuration of the secondary coil 18 is rectangular-tubular or cylindrical.

As shown in FIG. 12, when a voltage generated in the secondary coil 16 is set at 15 kV in the above experiment method, the electrical field strength is reduced, but the tendency similar to a case of the generation voltage of 30 kV is shown. That is, it is found out that when a relation of "B/A≧1.5" is satisfied, the electrical field strength is saturated. Therefore, even if the generation voltage of the secondary coil 16 is changed, when the secondary coil 16 and the outer periphery core 18 are arranged so that a relation of "B/A≧1.5" is satisfied, the dielectric breakdown lifetime of the plastic member 20 improves and as a result, durability of the ignition coil 100 also improves.

Figure 13:
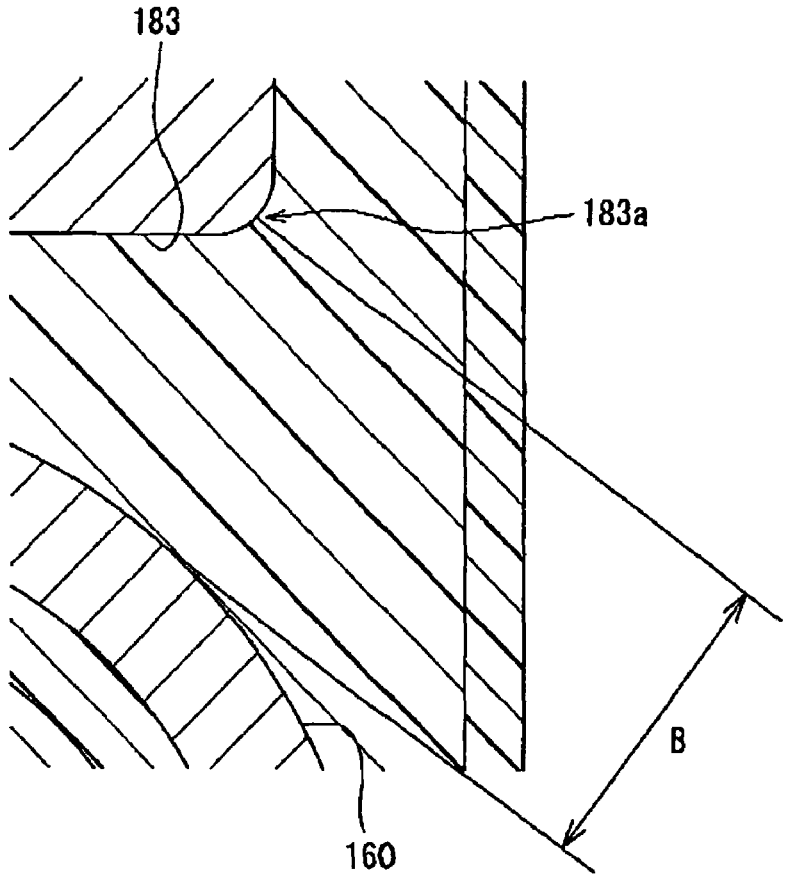
FIG. 13 is an enlarged diagram showing a main section D in FIG. 9.

As shown in FIG. 9, and in FIG. 13 as an enlarged diagram showing a part D in FIG. 9, it is preferable that at least the outer edges 183*a* and 183*b* of the opposing surface 183 are chamfered for each of the outer edges 183*a* and 183*b* to be rounded. By chamfering the outer edges 183*a* and 183*b* in this way, the local electrical field concentration is further restricted, improving the dielectric breakdown lifetime and durability of the ignition coil 100.

Further, increasing the shortest distance A causes reduction in the electrical field strength, thereby improving durability of the ignition coil 100. However, an increase in the shortest distance A leads to an increase in size of the ignition coil 100. Therefore, the present embodiment is more desirable than an arrangement of improving durability of the ignition coil 100 by increasing the shortest distance A, since the present embodiment can realize durability and downsizing of the ignition coil 100 at the same time by satisfying a relation of "B/A>1".

Third Embodiment

Hereinafter, the third embodiment will be described, but since the fundamental arrangement thereof is the same as in the above embodiments, only remarkable different points will be explained below.

Figure 14:
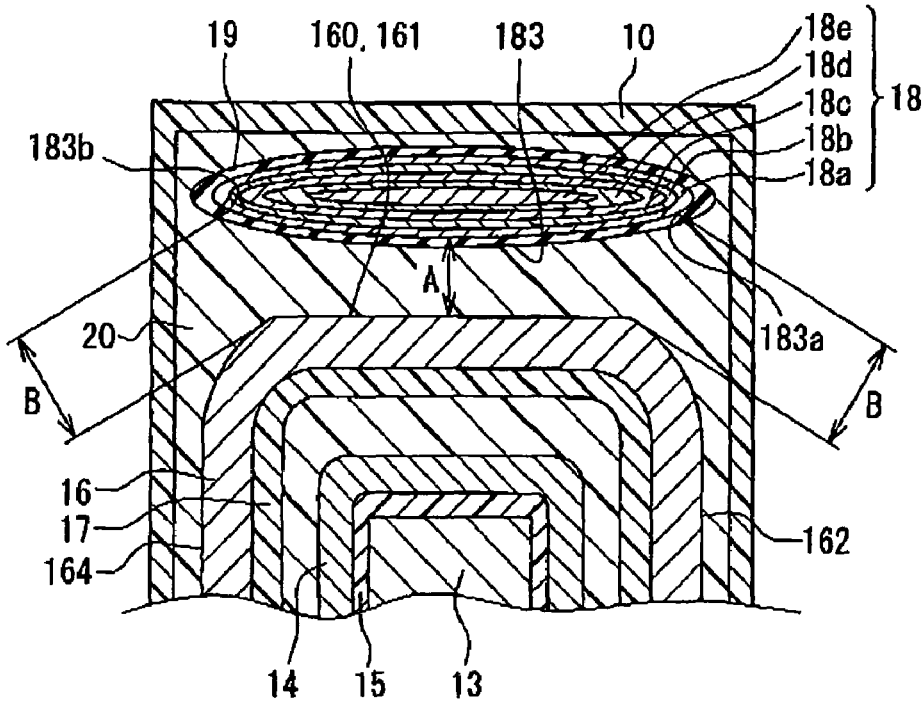
FIG. 14 is a diagram showing a third embodiment of the invention.
Figure 15:
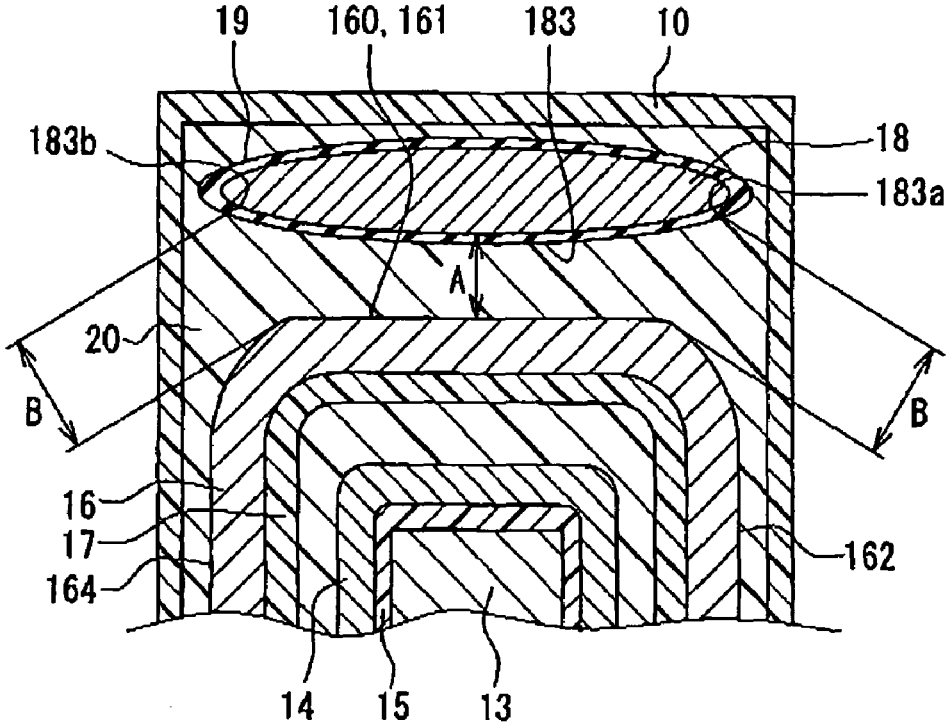
FIG. 15 is a diagram showing a modification of the third embodiment.

FIG. 14 shows a cross section of the ignition coil 100 in its axial direction in the third embodiment. Components corresponding to those in FIG. 2 are referred to as the same numerals as in the case of the second embodiment. As shown in FIG. 14, magnetic plates 18*a* to 18*e* each having a different size and a substantially elliptic cross section are used to form an outer periphery core 18, which has a substantially elliptic shape. In this arrangement, outer edges 183*a* and 183*b* of an opposing surface 183 in the outer periphery core 18 correspond to points at which the curvature of the opposing surface 183 in a cross section of the outer periphery core 18 perpendicular to an axial direction of a secondary coil 16 changes, more specially, to boundary points between an arc having a relatively small curvature and arcs having relatively large curvatures at both ends of the magnetic plate 18*a* in the right-left direction, on the opposing surface 183 shown in FIG. 14. Therefore, the outer edges 183*a* and 183*b* in the present embodiment are much more rounded as compared to the first embodiment, leading to less generation of the electrical field concentration. In consequence, even in a case where, for example, B/A is smaller than "1.5," it is possible to reduce the generated electrical field strength to about 60% of the electrical field strength generated in a case of "B/A=1thus achieving the effect similar to the first embodiment. When a relation of "B/A≧1.5" is satisfied, the electrical field strength to be generated can be further reduced, improving durability of the ignition coil 100. In the present embodiment, the magnetic plates 18*a* to 11*e* each having a substantially elliptic cross section are used to form the outer periphery core 18 having a cross section in a substantially elliptic shape as a whole, but, as shown in FIG. 15, as in the case of the second embodiment, the outer periphery core 18 may be molded by pressing magnetic powder to reduce manufacturing costs of the outer periphery core 18. In FIG. 15 also, the outer edges 183*a* and 183*b* indicate boundary points at which the curvature changes in the opposing surface 183, but do not indicate points at which the curvature is maximized in macro perspective as in the case of each of the first and second embodiments. That is, in a case where the cross section configuration of the outer periphery core 18 is substantially circular as in the case of the present embodiment, a point at which the electrical field concentration tends to be most easily generated on the opposing surface 183 is not a point at which the curvature is maximized in macro perspective, but a boundary point at which the curvature changes in macro perspective. Since this phenomenon is found out by studies of the present inventor, the outer edges 183*a* and 183*b* are additionally defined in the present embodiment so as to be different from the above-mentioned. By optimizing the shortest distance B from an outer peripheral surface 160 of a secondary coil 16 to each of the outer edges 183*a* and 183*b* depending on the configuration of the outer periphery core 18, an improvement on durability of the ignition coil 100 can be achieved in accordance with the configuration of the outer periphery core 18.

Fourth Embodiment

Hereinafter, the fourth embodiment will be described, but since the fundamental arrangement thereof is the same as in the above embodiment, only noteworthy different points t will be explained.

Figure 16:
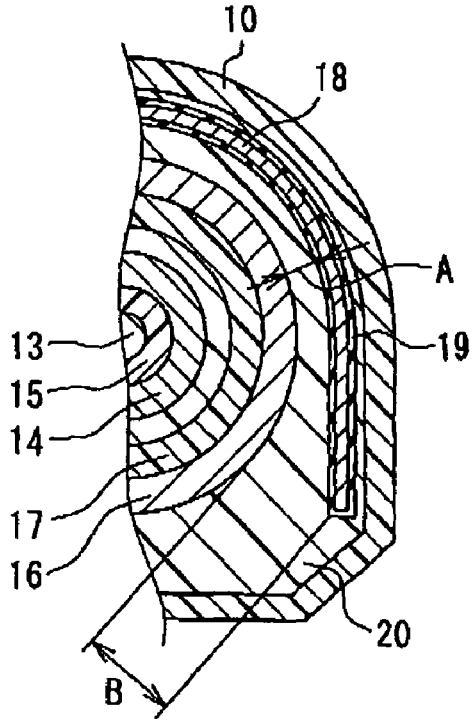
FIG. 16 is a diagram showing a fourth embodiment of the invention.

FIG. 16 shows a cross section of the ignition coil 100 in its axial direction in the fourth embodiment. Components corresponding to those in FIG. 2 are referred to as the same numerals, similar to the above embodiment. As shown in FIG. 16, a cylindrical primary spool 15, a cylindrical primary coil 14, a cylindrical secondary spool 17, a columnar central core 13 and a cylindrical secondary coil 16 are used, and in addition thereto, an outer periphery core 18 whose a cross section in a radial direction of the secondary coil 16 has a U-letter shape is used. It is possible to establish a relation of "B/A≧1.5" even by the ignition coil 100 configured by these elements 13 and 18, achieving the effect similar to the ignition coil 100 of the first embodiment. That is, the outer periphery core 18 is not limited to the one having a substantially U-letter shape as a whole, but when an opposing surface 183 of the outer periphery core 18 can be arranged to establish a relation of "B/A≧1.5" with respect to an outer peripheral surface 160 of the secondary coil 16, there is no limitation to the configuration of the outer periphery core 18.

Fifth Embodiment

Hereinafter, the fifth embodiment will be described, but since the fundamental arrangement thereof is the same as in the above embodiment, only noteworthy different points will be explained.

Figure 17:
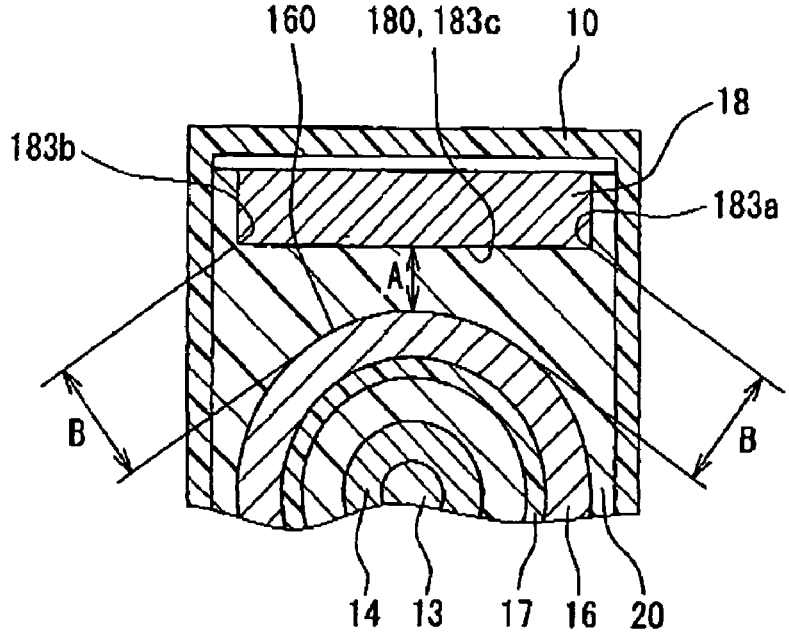
FIG. 17 is a diagram showing a fifth embodiment of the invention.

FIG. 17 shows a cross section of the ignition coil 100 in its axial direction in the fifth embodiment. Components corresponding to those in FIG. 2 are referred to as the same numerals, similar to the above embodiment. A central core 13 is formed by pressing magnetic powder, for example, powder of a magnetic metal unit such as iron, cobalt and nickel or an alloy including mainly the magnetic metal unit and is substantially columnar as a whole. The outer peripheral surface of the columnar central core 13 molded in this way has a smooth curved surface on which a few concave and convex portions whose curvature is large in micro perspective exist, as compared to the outer peripheral surface of the central core 13 configured by stacking silicon steel plates or the like. Therefore, it is possible to wind a primary coil 14 directly around the central core 13 without use of a plastic primary spool 15. That is, Because the primary spool 15 is not necessary, it is possible to further reduce a diameter of each of a cylindrical secondary spool 17 and a cylindrical secondary coil 16 which are arranged on the outer periphery side of the primary coil 14. In consequence, downsizing of the ignition coil 100 can be realized. The central core 13 formed by pressing has an advantage of reducing manufacturing costs and man-hour as compared to the central core formed by stacking silicon steel plates or the like.

It is possible to increase the winding number of each of the first coil 14 and the second coil 16 as compared to the above embodiment, because the diameter of each of the second spool 17 and the secondary coil 16 is made small as described above. In consequence, a voltage generated in the secondary coil 16 can be increased with the same body size as the ignition coil 100 of the above embodiment.

Other Embodiments

Although the present invention has been fully described in connection with the preferred embodiments thereof with reference to the accompanying drawings, it is to be noted that various changes and modifications will become apparent to those skilled in the art.

For example, the stress relaxation member 19 is used in the outer periphery core 18 in the first embodiment, but for cutting down on manufacturing costs and man-hour, even if the ignition coil 100 is configured without use of the stress relaxation member 19, the effect substantially similar to the above embodiment can be acquired. For further cutting down on the man-hour, it is preferable to form the secondary coil 16 with slant-direction winding. Since the secondary coil 16 formed with slant-direction winding can reduce a interlayer voltage between neighboring enamel wire portions in the enamel wire constituting the secondary coil 16, it is also possible to restrict dielectric breakdown of the secondary coil 16 caused by this interlayer voltage. The collar portion of the secondary spool 17 required for the slot winding becomes unnecessary by forming the secondary coil 16 with the slant-direction winding as shown in FIG. 10. Therefore, it is possible to reduce the manufacturing costs of the ignition coil 100.

Figure 18:
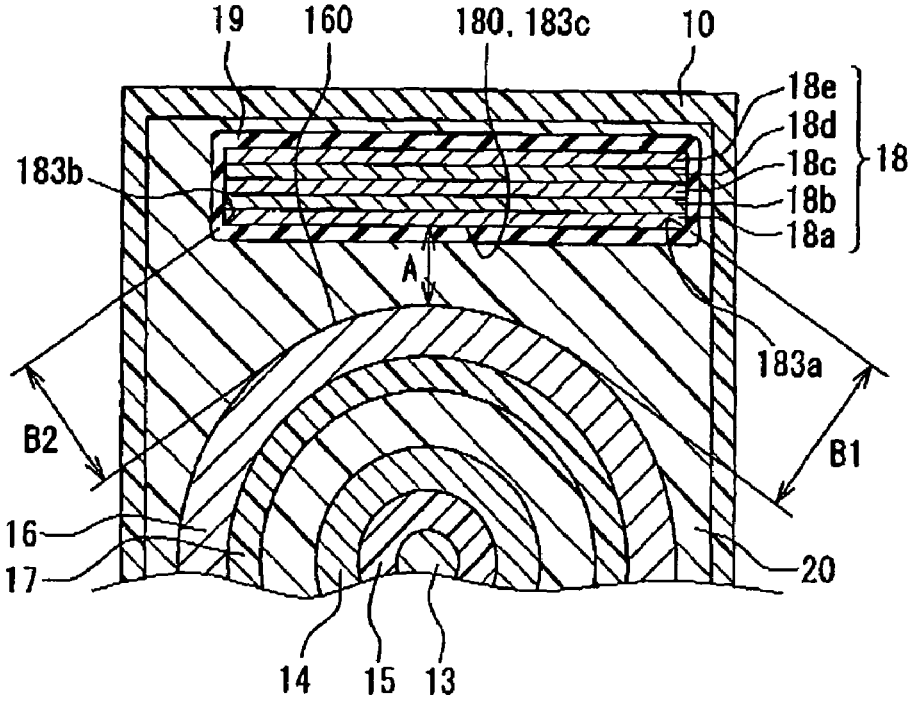
FIG. 18 is a diagram showing a modification of FIG. 11.

As shown in FIG. 18, the elements 13 to 18 may be arranged so that the axis of the elements 14 to 17 including the central core 13 is offset in the horizontal direction of the central core 13 from the axis of the outer periphery core 18 in the longitudinal direction of the opposing surface 183. That is, the elements 13 to 18 may be arranged so that the outer periphery core 18 is offset in the right-left direction in FIG. 18. In this arrangement, the shortest distance B between each of the outer edges 183*a* and 183*b* of the outer periphery core 18 and the outer peripheral surface 160 of the secondary coil 16 is as follows. A relation of the shortest distance B1 between the outer edges 183*a* and the outer peripheral surface 160, and the shortest distance B2 between the outer edges 183*b* and the outer peripheral surface 160 is defined as a relation of "B1>B2". Therefore, the outer edge 183*b*, the shortest distance of which to the outer peripheral surface 160 of the secondary coil 16 is shorter, tends to easily generate the local electrical field concentration as compared to the outer edge 183*a*. Accordingly, in such a case, B2 is adopted as the shortest distance B used in the above embodiment. That is, by constituting the ignition coil 100 in such a manner as to satisfy a relation of "B2/A≧1.5", the effect similar to that in the above embodiment can be acquired.

Figure 19:
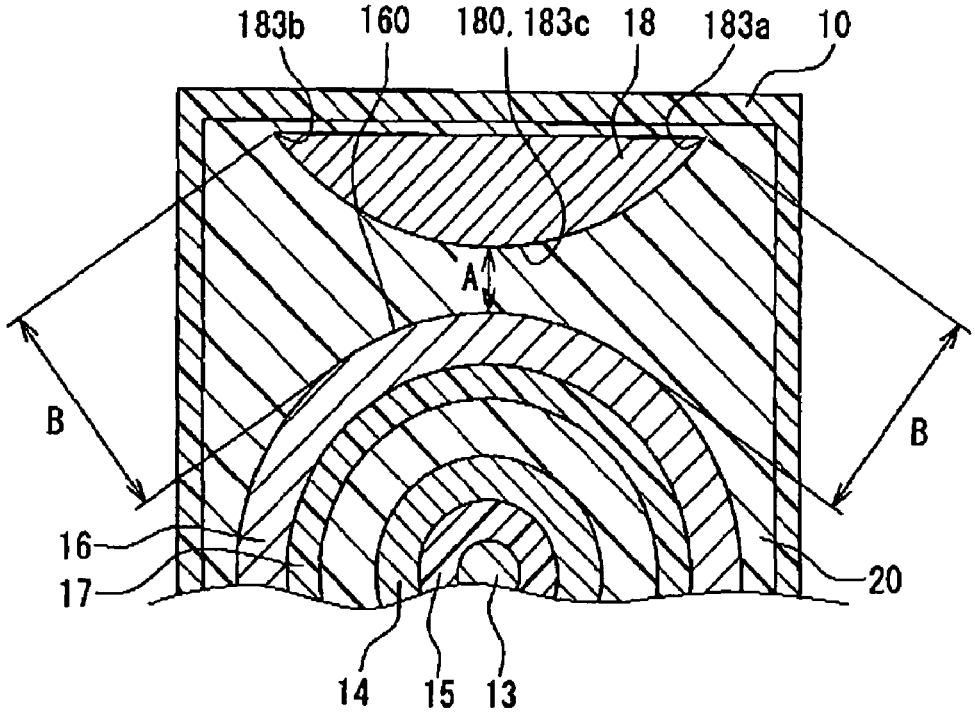
FIG. 19 is a diagram showing a modification of FIG. 11.

If the shortest distance A and the shortest distance B are defined in a range of satisfying a relation of "B/A≧1.5", the configuration and the manufacturing method of the outer periphery core 18 has no particular limitation. For example, as shown in FIG. 19, even if the magnetic material is molded under pressurization to form an outer periphery core 18 having a cross section in a substantially semi-circular shape for use, the effect similar to that in the above embodiment can be acquired.

Figure 20:
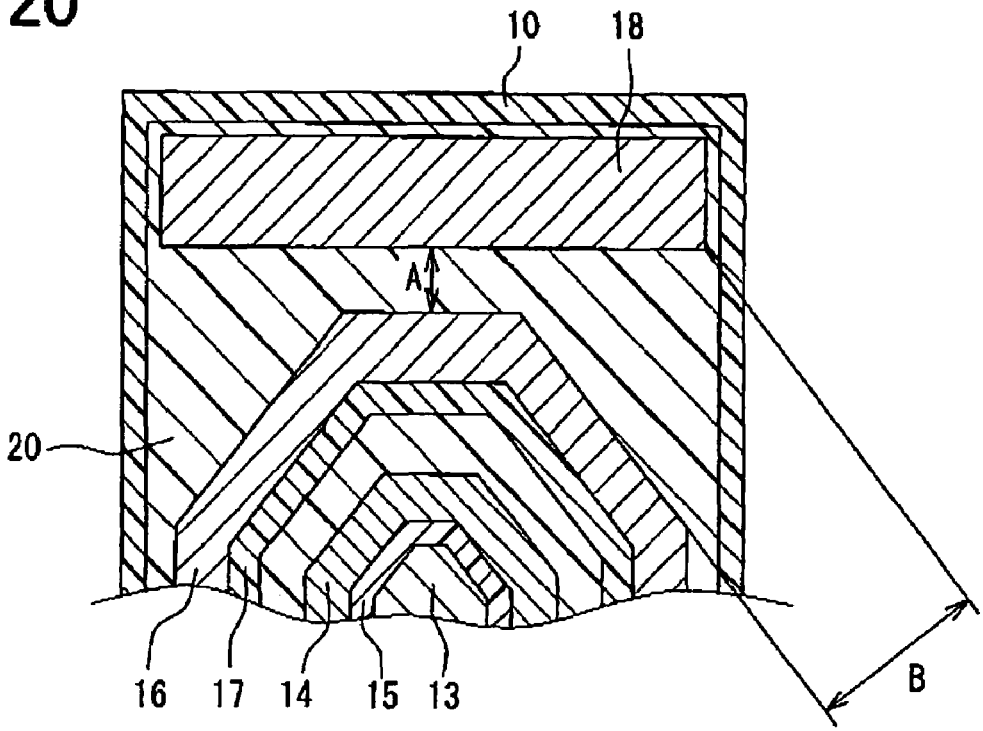
FIG. 20 is a diagram showing a modification of FIG. 11.

As shown in FIG. 20, each of a central core 13, a primary coil 14, a primary spool 15, a secondary coil 16 and a secondary spool 17 may have an octagonal cross section. Among these elements 13 to 17, at least the secondary coil 16 may be configured as having a polygonal shape. As the cross section configuration of the secondary coil 16 is closer to a circular shape, a length of an outer periphery core 18 in the width direction of the opposing surface (horizontal direction in FIG. 20) may be further reduced. In this manner as well, a relation of "B/A>1" can be established. Therefore, it is possible to realize miniaturization of the ignition coil 100.

Figure 21:
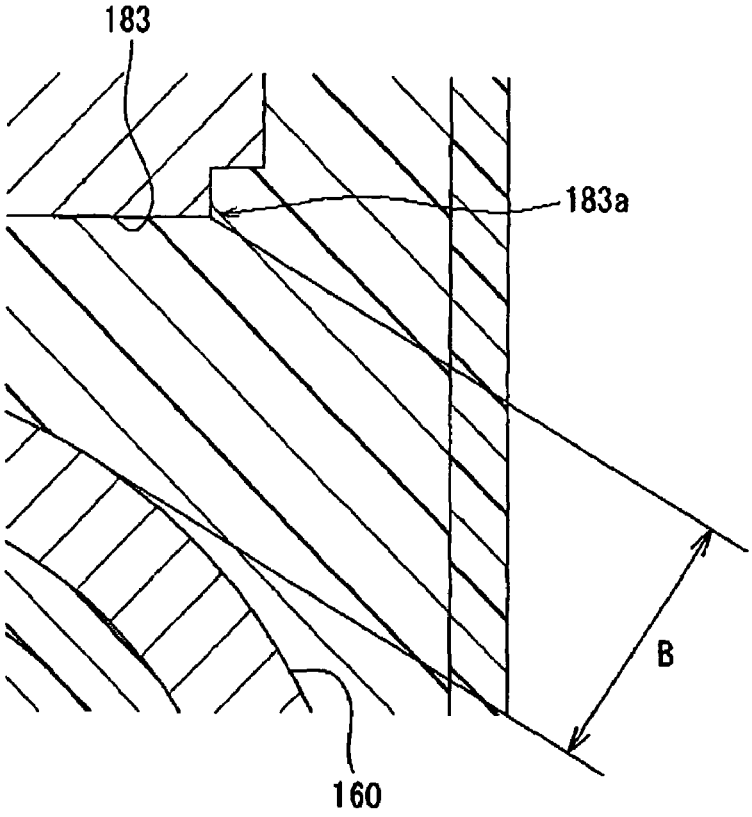
FIG. 21 is a diagram showing a modification of FIG. 13.
Figure 22:
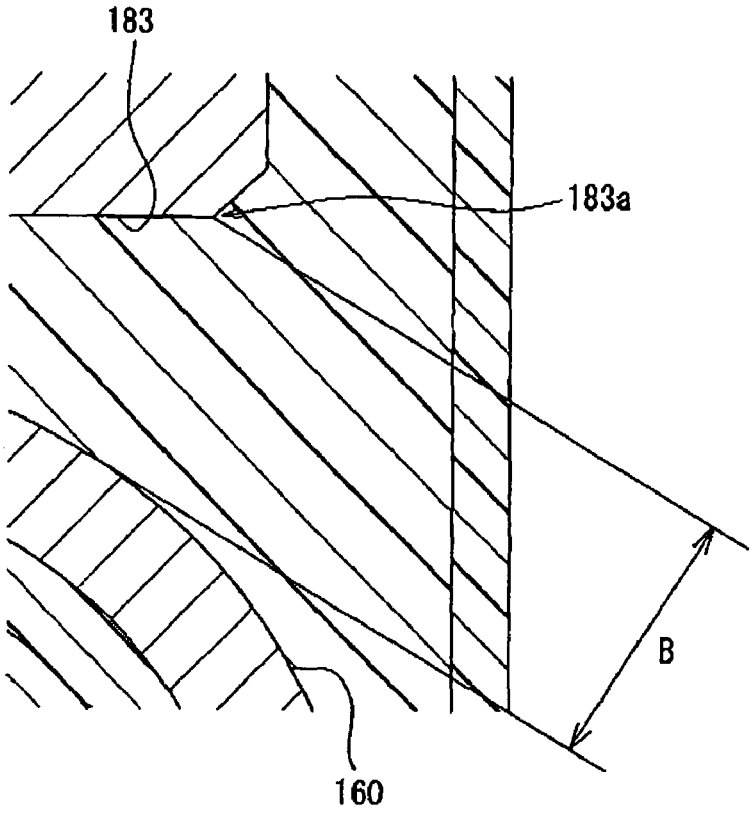
FIG. 22 is a diagram showing a modification of FIG. 13.

As in the case of the second embodiment shown in FIG. 13, each of the outer edges 183*a* and 183*b* has the rounded shape, but as shown in FIG. 21, each of outer edges 183*a* and 183*b* may be configured as having a stepped shape. Further, as shown in FIG. 22, each of outer edges 183*a* and 183*b* may be configured as roughly chamfered.

Figure 23:
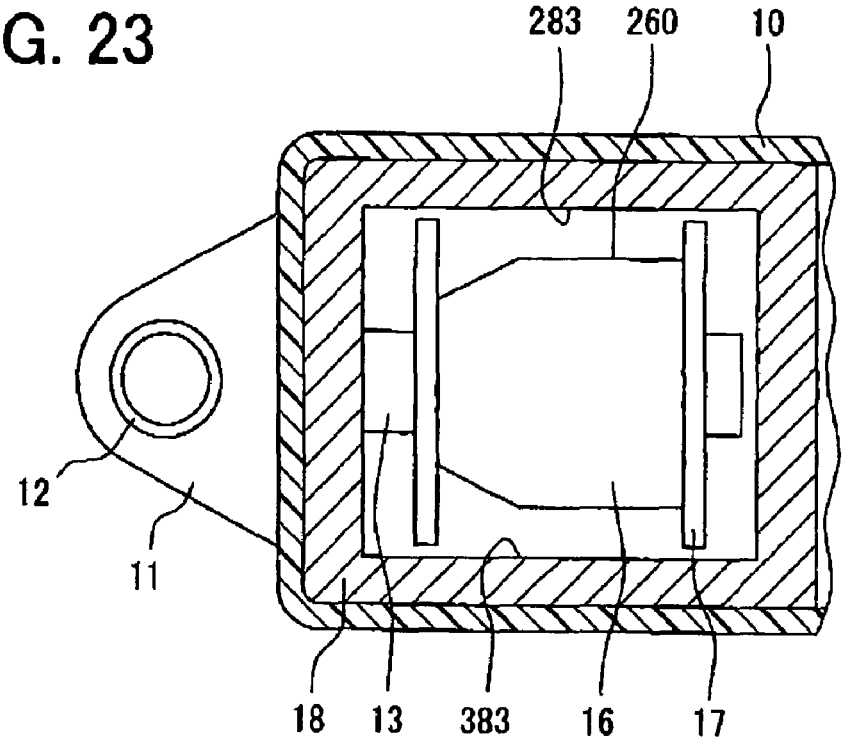
FIG. 23 is a diagram showing a modification of FIG. 3.

In the first embodiment, the outer periphery core 18 having the U-letter shape and the central core 13 having the rectangular, columnar shape are connected to form a closed magnetic path, but cores 18 and 13 both formed in a L-letter shape may be connected to form a closed magnetic path having a substantially rectangular shape, or as shown in FIG. 23, a tubular, outer periphery core 18 opened in the axial direction of the plug hole 2 and a columnar, central core 13 may be connected to form a closed magnetic path.

In this arrangement, two opposing surfaces 283 and 383 are formed with respect to an outer peripheral surface 260 of the secondary coil 16. By adopting the configuration similar to the opposing surface 183 of the above embodiment in regard to each of the opposing surfaces 283 and 383, the effect similar to that in the above embodiment can be acquired. In other words, the configuration of each of the outer periphery core 18 and the central core 13 has no particular limitation as long as the outer periphery core 18 and the central core 13 achieve the effect similar to that in the above embodiment.

Such changed and modifications are to be understood as being within the scope of the present invention as defined by the appended claims.

What is claimed is:

1. An ignition coil comprising:

a primary coil (14);

a secondary coil (16) disposed on an outer circumferential side of the primary coil (14) and configured to be boosted by mutual induction with the primary coil (14);

an outer periphery core (18) having an opposing surface (183), which is opposed to an outer peripheral surface (160) of the secondary coil (16); and an insulating member (20) disposed between the outer peripheral surface (160) and the opposing surface (183), wherein the secondary coil (16) and the outer periphery core (18) are arranged such that B is larger than A, given that A is a shortest distance between the outer peripheral surface (160) and the opposing surface (183) and B is a shortest distance between the outer peripheral surface (160) and an outer edge (183*a*, 183*b*) of the opposing surface (183).

2. The ignition coil according to claim 1, wherein the outer periphery core (18) and the secondary coil (16) are arranged so as to satisfy a relation of $B/A \geqq 1.5$.

3. The ignition coil according to claim 1, wherein the outer periphery core (18) and the secondary coil (16) are arranged so as to satisfy a relation of $B/A \geqq 2.0$.

4. The ignition coil according to claim 1, wherein:

the secondary coil (16) is formed in a cylindrical shape having a rectangular cross section; and the outer edge (183*a*, 183*b*) is located away from the opposing surface (183) of the outer periphery core (18), which is fully opposed to the secondary coil (16).

5. The ignition coil according to claim 1, wherein the secondary coil (16) is formed in a cylindrical shape.

6. The ignition coil according to claim 1, wherein:

the outer periphery core (18) includes a plurality of magnetic plates (18*a* to 18*e*) stacked in a radial direction of the secondary coil (16); and a magnetic plate (18*a*) of the plurality of magnetic plates (18*a* to 18*e*) is configured to serve as an entire area of the opposing surface (183).

7. The ignition coil according to claim 6, wherein the outer periphery core (18) is formed by pressure-molding a magnetic powder.

8. The ignition coil according to claim 1, wherein the outer periphery core (18) includes a single magnetic plate, which is configured to serve as an entire area of the opposing surface (183).

9. The ignition coil according to claim 8, wherein the outer periphery core (18) is formed by pressure-molding a magnetic powder.

10. The ignition coil according to claim 1, wherein the outer edge (183*a*, 183*b*) of the opposing surface (183) is chamfered.

11. The ignition coil according to claim 1, wherein at least the outer edge (183*a*, 183*b*) of the opposing surface (183) of the outer periphery core (18) is covered with a stress relaxation member (19), which is configured to relax a stress generated on an interfacial surface between the outer periphery core (18) and the insulating member (20).

12. The ignition coil according to claim 11, wherein the stress relaxation member (19) is a heat shrinkable tube and covers an entire area of the opposing surface (183) of the outer periphery core (18).

13. The ignition coil according to claim 1, wherein a cross-sectional area of the secondary coil (16) in a radial direction thereof on a high-voltage side of the secondary coil (16) in an axial direction thereof is smaller than a cross-sectional area of the secondary coil (16) in a radial direction thereof on a low-voltage side of the secondary coil (16) in an axial direction thereof.

14. The ignition coil according to claim 1, wherein the outer periphery core (18) is earthed to a ground.

15. The ignition coil according to claim 1, further comprising a central core (13) that is formed by pressure-molding a magnetic powder, wherein the outer periphery core (18) and the central core (13) constitute a magnetic path.

16. The ignition coil according to claim 1, wherein a cross-sectional area of the outer periphery core (18) along a radial direction of the secondary coil (16) increases in a direction from a high-voltage side toward a low-voltage side of the secondary coil (16).

* * * * *